US008002519B2

(12) United States Patent
Yamamoto et al.

(10) Patent No.: US 8,002,519 B2
(45) Date of Patent: Aug. 23, 2011

(54) BLOWER AND AIR CONDITIONER OUTDOOR UNIT WITH THE BLOWER

(75) Inventors: Jiro Yamamoto, Sakai (JP); Masahiro Shigemori, Sakai (JP); Kouji Somahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 824 days.

(21) Appl. No.: 11/922,586

(22) PCT Filed: Jul. 24, 2006

(86) PCT No.: PCT/JP2006/314544

§ 371 (c)(1),
(2), (4) Date: Dec. 20, 2007

(87) PCT Pub. No.: WO2007/011046

PCT Pub. Date: Jan. 25, 2007

(65) Prior Publication Data

US 2008/0273973 A1 Nov. 6, 2008

(30) Foreign Application Priority Data

Jul. 22, 2005 (JP) ..... 2005-212398

(51) Int. Cl.
*F04D 29/38* (2006.01)
*F04D 29/66* (2006.01)

(52) U.S. Cl. ..... 415/119; 415/220; 416/244 R; 416/247 R; 416/500

(58) Field of Classification Search ..... 415/119, 415/220; 416/244 R, 247 R, 500
See application file for complete search history.

(56) References Cited

U.S. PATENT DOCUMENTS

| | | | | |
|---|---|---|---|---|
| 2,028,985 | A | 1/1936 | Mahon | |
| 2,808,124 | A | 10/1957 | Attwood | |
| 3,199,774 | A | 8/1965 | Lowell | |
| 3,278,114 | A | 10/1966 | Gibbs | |
| 3,540,547 | A | 11/1970 | Coward et al. | |
| 6,688,848 | B2 * | 2/2004 | Ohtsuka | 416/189 |
| 6,866,474 | B2 * | 3/2005 | Uselton | 415/121.2 |

FOREIGN PATENT DOCUMENTS

| | | | |
|---|---|---|---|
| DE | 1451234 | A1 | 5/1969 |
| JP | 56-144271 | U | 10/1981 |
| JP | 61-136200 | U | 8/1986 |
| JP | 5-223093 | A | 8/1993 |
| JP | 11-223365 | A | 8/1999 |

(Continued)

*Primary Examiner* — Igor Kershteyn
(74) *Attorney, Agent, or Firm* — Birch, Stewart, Kolasch & Birch, LLP.

(57) ABSTRACT

A blower is provided with an axial flow impeller 7, a fan motor 8 positioned in a suction side of the axial flow impeller 7, and a motor stay 9 supporting the fan motor 8. The motor stay 9 is substantially formed to have a linear shape and attached in parallel to a rotating surface of the axial flow impeller 7. An impeller blade front edge 17 of the axial flow impeller 7 is positioned in a region X which is closer to the motor stay 9 than a region Y in which an air flow turbulence in a wake flow of the motor stay 9 is expanded, and in which region X a range of the air flow turbulence is reduced. Accordingly, it is possible to inhibit the air flow turbulence in the wake flow of the motor stay 9 from affecting the aerodynamic characteristics and noise characteristics (for example, an increase of an NZ noise) of the axial flow impeller 7.

3 Claims, 3 Drawing Sheets

FOREIGN PATENT DOCUMENTS

| | | | | |
|---|---|---|---|---|
| JP | 2003-42094 | A | | 2/2003 |
| JP | 3094737 | U | | 4/2003 |
| JP | 2003-130394 | A | | 5/2003 |
| JP | 2003232541 | A | * | 8/2003 |
| JP | 2003-343489 | A | | 12/2003 |
| JP | 2005-147018 | | | 6/2005 |

* cited by examiner

BLOWER AND AIR CONDITIONER OUTDOOR UNIT WITH THE BLOWER

TECHNICAL FIELD

The present invention relates to a blower and an air conditioner outdoor unit with the blower.

BACKGROUND ART

Conventionally, as an air conditioner outdoor unit, for example, there is a structure in which a blowing fan is arranged in an upper portion of a casing and a heat exchanger having a U-shaped cross section is arranged within the casing.

In the case that the air conditioner outdoor unit having the structure mentioned above is made compact, a space between the heat exchanger and a top surface of the casing is reduced in size. Accordingly, the distance between the blowing fan, and the heat exchanger and the top surface of the casing is unavoidably shortened. In this case, if a structural object exists upstream of the blowing fan, suction air flow of the fan may be obstructed. Accordingly, as a countermeasure thereof, the fan is arranged in a state in which the center of the fan and the structural object are eccentric.

Structural objects existing upstream of the blowing fan include a fan motor and a motor stator supporting the fan motor. In the air conditioner outdoor unit, the fan motor is generally arranged in a suction side of the blowing fan, and the height direction of the outdoor unit is made compact. If a blowing fan having a large diameter (in this case, the height in an axial direction becomes larger in addition to an outer diameter) is arranged as the blower of the outdoor unit mentioned above, an arranging space of the fan motor and the motor stator is reduced in size, and a turbulence of a suction air flow is generated by the motor stay, so that an NZ noise (a peak noise having a frequency equal to the product NZ of the number of impeller blades N and a rotation speed Z of the blowing fan) may become loud. Accordingly, there has been proposed a structure intending to solve the problem mentioned above by curving or bending the motor stay in a direction away from the blowing fan (refer to Patent Document 1).

Further, in the case that the air conditioner outdoor unit is made compact, the blowing fan and the casing are arranged close to each other. As a result, there is a problem that a side surface of the casing and an impeller of the blowing fan are interfered with each other, and the NZ noise is increased. Particularly, in the case that the heat exchanger is not provided on a whole side surface of the casing, the suction air flow drifts in the rotating direction of the blowing fan. Accordingly, there is a problem that the NZ noise tends to become loud.

As a method of suppressing the increase of the NZ noise mentioned above, there has been proposed a structure which is designed to suppress the increase of the NZ peak noise by employing a variable pitch impeller in which an interval of an attaching pitch of the impeller blades in the rotating direction of the impellers is uneven, thereby slightly shifting an interference cycle between the impeller blade and the side surface of the casing (refer to Patent Document 2).

Patent Document 1: Japanese Laid-Open Patent Publication No. 2003-130394

Patent Document 2: Japanese Laid-Open Patent Publication No. 5-223093

DISCLOSURE OF THE INVENTION

However, as disclosed in Patent Document 1 mentioned above, in the case of the structure in which the motor stay is curved or bent in the direction away from the blowing fan, the shape of the motor stay is complicated and the assembly of the motor stay is complicated as well. Accordingly, in order to achieve a simplification of the shape and the assembly of the motor stay, there is a case of employing a structure in which the fan motor is supported by the motor stay which is substantially linearly formed and is attached in parallel to a rotating surface of the impeller.

In the case of the structure of the motor stay mentioned above, a front edge of the impeller blade in the impeller of the blowing fan comes close to the motor stay on the basis of the compact structure of the air conditioner outdoor unit, and a turbulence of an air flow in a wake flow of the motor stay affects the aerodynamic characteristics and the noise characteristics of the fan. Particularly, there occurs a problem that the NZ noise is increased in the noise characteristics.

By employing the uneven pitch impeller disclosed in the Patent Document 2 mentioned above, it is possible to reduce the NZ noise caused by the interference between the side surface of the casing and the blowing fan and the drift on the upstream side (in other words, the drift generated by the structure in which the heat exchanger is not provided in the whole surface of the casing). However, there is a problem that the NZ noise of the entire outdoor unit cannot be reduced until the NZ noise caused by the air flow turbulence of the drift of the motor stay is reduced.

Accordingly, it is an objective of the present invention to provide a blower and an air conditioner outdoor unit which reduce the NZ noise generated in accordance with the compactification of the air conditioner outdoor unit and improve the aerodynamic characteristics.

In order to achieve the foregoing objective and in accordance with a first aspect of the present invention, a blower including an axial flow impeller 7, a fan motor 8 positioned on a suction side of the axial flow impeller 7, and a motor stay 9 supporting the fan motor 8 is provided. The motor stay 9 is formed substantially as a linear shape and is attached in parallel to a rotating surface of the axial flow impeller 7. An impeller blade front edge 17 of the axial flow impeller 7 is positioned in a region X which is closer to the motor stay 9 than a region Y in which an air flow turbulence in a wake flow of the motor stay 9 is expanded, and in which a range of the air flow turbulence is narrower than the region Y.

In accordance with the structure mentioned above, it is possible to inhibit the air flow turbulence in the wake flow of the motor stay 9 from affecting the aerodynamic characteristics and the noise characteristics (for example, an increase of the NZ noise) of the axial flow impeller 7, and it is possible to achieve both of the downsizing of the blower and the reduction of the NZ noise.

In the blower mentioned above, it is preferable that values L and W are set to a range satisfying $L/W<2.5$, in which an interval between the motor stay 9 and the impeller blade front edge 17 of the axial flow impeller 7 is represented by L, and the width of the motor stay 9 is represented by W. In this case, it is possible to achieve the reduction of the NZ noise without significantly increasing a shaft power of the fan motor 8. If the values L and W are set to a range $L/W \geqq 2.5$, the impeller blade front edge 17 of the axial flow impeller 7 is positioned in the region Y in which the air flow turbulence in the wake flow of the motor stay 9 is expanded. Accordingly, the air flow turbulence in the wake flow of the motor stay 9 greatly affects the aerodynamic characteristics and the noise characteristics (for example, the increase of the NZ noise) of the axial flow impeller 7.

The values L and W are preferably set to a range satisfying $0.5<L/W$. In this case, it is possible to prevent an interference noise from being generated due to the structure in which the motor stay 9 and the impeller blade front edge 17 of the axial flow impeller 7 come too close. If the values L and W are set to a range L/W≦0.5, the impeller blade front edge 17 of the axial flow impeller 7 comes too close to the motor stay 9. Accordingly, the NZ noise is increased on the contrary.

Further, in the blower mentioned above, it is preferable that an arrangement of the impeller blades of the axial flow impeller 7 is constituted by an uneven pitch arrangement. In this case, it is possible to slightly shift an interference cycle between the impeller blade and a side wall of the casing, and a generating cycle of a vane surface turbulence generated by a drift in the rotating direction of the suction air flow. As a result, the increase of the NZ noise can be suppressed, and it is possible to improve the noise characteristics as a whole.

In accordance with a second aspect of the present invention, an upward blowing type air conditioner outdoor unit having the above described blower is provided. In this case, it is possible to obtain the air conditioner outdoor unit which can achieve the downsizing of the apparatus and the reduction of an operating noise.

BEST MODE FOR CARRYING OUT THE INVENTION

One preferable embodiment according to the present invention will now be described with reference to the accompanying drawings.

A blower in accordance with the present embodiment is applied to an upward blowing type air conditioner outdoor unit.

Figure 1:
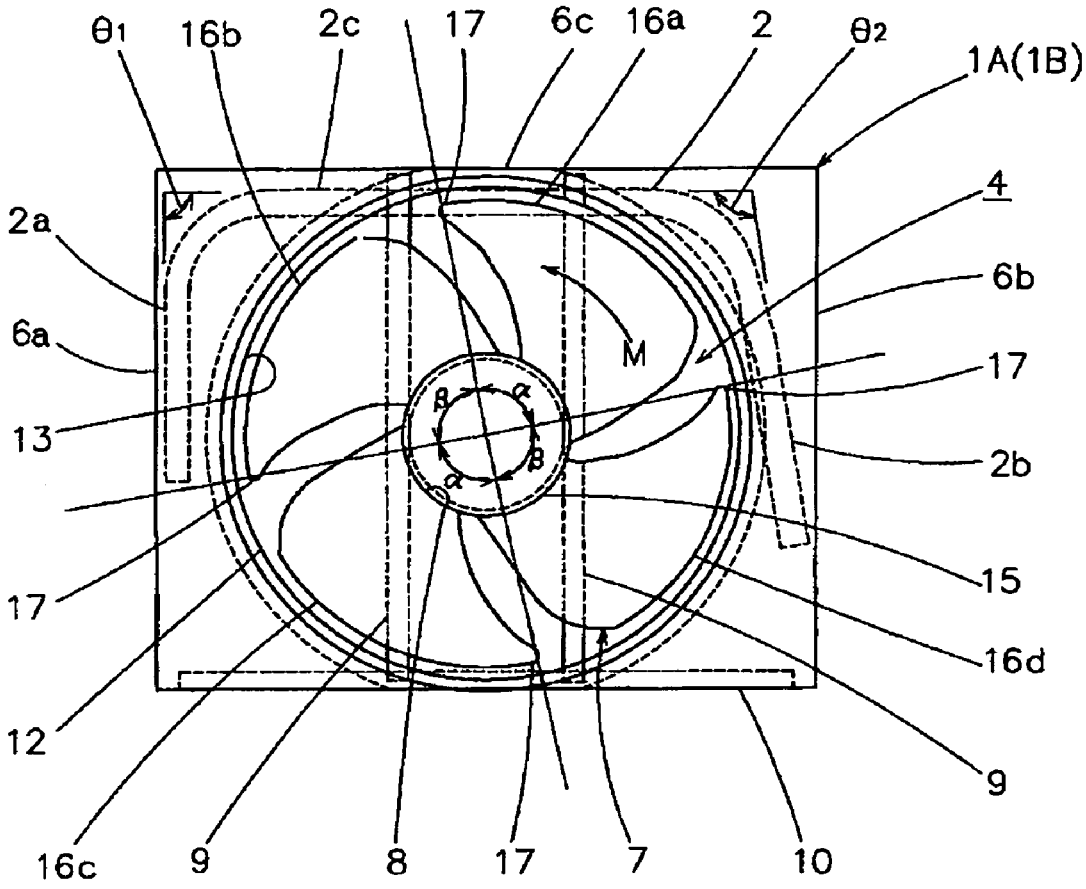
FIG. 1 is a plan view showing an air conditioner outdoor unit provided with a blower in accordance with the present embodiment.
Figure 2:
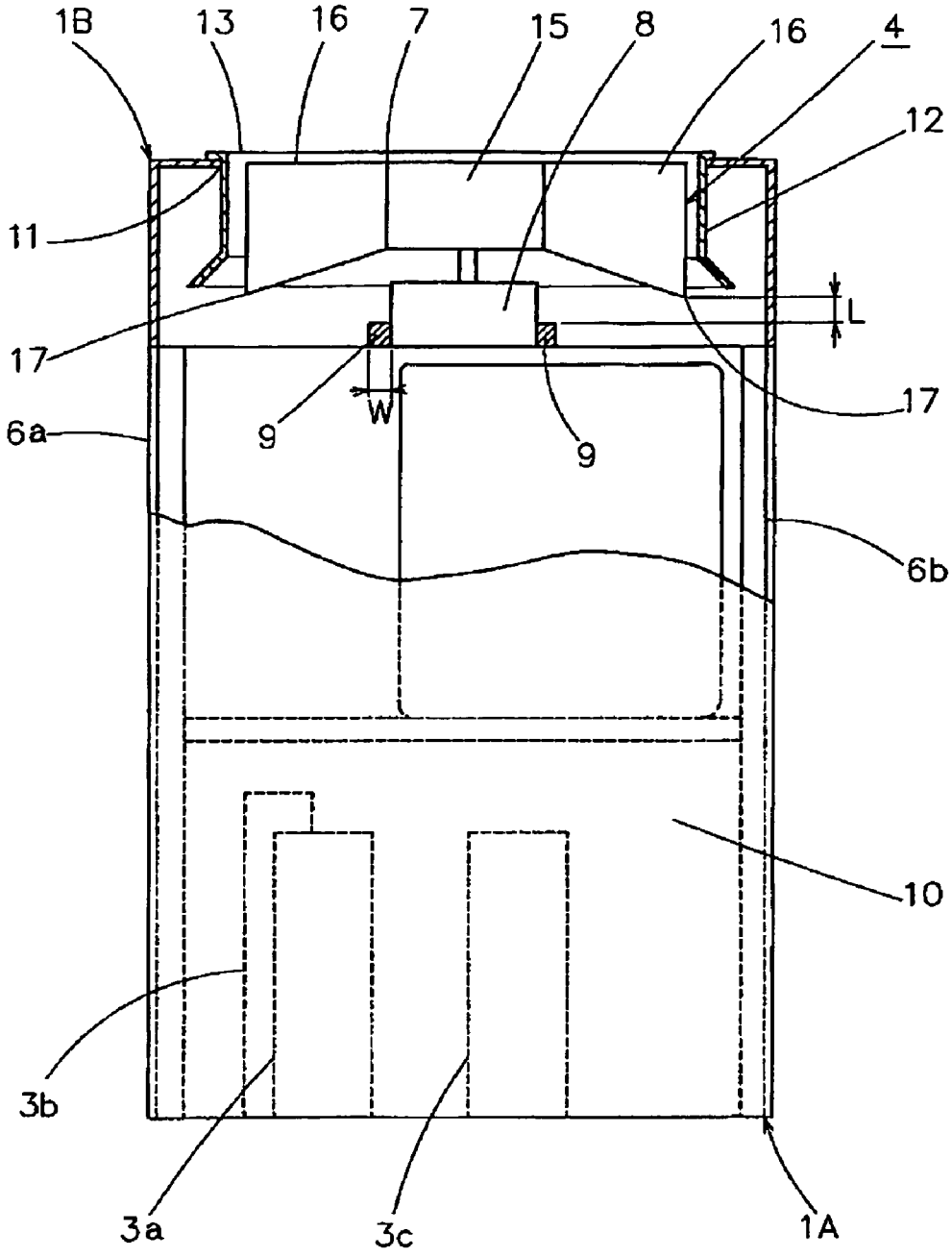
FIG. 2 is a partially cutaway front view showing the air conditioner outdoor unit provided with the blower.

The air conditioner outdoor unit is provided with a lower casing 1A and an upper casing 1B, as shown in FIGS. 1 and 2. A heat exchanger 2 and various devices (for example, a compressor 3*a*, an accumulator 3*b*, and a receiver 3*c*) are installed in the lower casing 1A. A blower 4 is installed in the upper casing 1B. Structurally, the lower casing 1A forming a center of the air conditioner outdoor unit is formed to have a rectangular cross-sectional shape in which the dimension in the lateral direction is long and the dimension in the front-rear direction is short, and is formed as a rectangular tube shape having a predetermined height in a vertical direction.

Air suction ports 6*a*, 6*b* and 6*c* are formed on three surfaces (for example, both right and left side surfaces and a back surface) in the lower casing 1A. The heat exchanger 2 is substantially formed to have a U-shaped cross-section and is arranged in correspondence to the air suction ports 6*a*, 6*b* and 6*c*. The heat exchanger 2 may be, for example, a fin and tube type heat exchanger. There are provided a heat exchanging portion 2*a* corresponding to the air suction port 6*a* positioned in the left side surface of the lower casing 1A, and a heat exchanging portion 2*b* corresponding to the air suction port 6*c* positioned in the back surface of the lower casing 1A. The heat exchanging portion 2*a* and the heat exchanging portion 2*c* are curved at a corner angle $\theta_1$=about 90° corresponding to the corner angle (90°) of the lower casing 1A. Further, in the heat exchanger 2, there are provided a heat exchanging portion 2*b* corresponding to the air suction port 6*b* positioned in the right side surface of the lower casing 1A, and the heat exchanging portion 2*c* corresponding to the air suction port 6*c* positioned in the back surface of the lower casing 1A. The heat exchanging portion 2*b* and the heat exchanging portion 2*c* are curved at a corner angle $\theta_2$=100° to 110°, which is larger than the corner angle $\theta_1$. Accordingly, it is possible to secure an effective air suction space even at a time when a right side of the outdoor unit is installed in contact with a wall surface of a building, or two outdoor units are installed adjacently. Each of the corner angles $\theta_1$ and $\theta_2$ may be set to satisfy the relation $\theta_1=\theta_2=90°$.

The blower 4 installed in the upper casing 1B is positioned above an upper end of the heat exchanger 2. The blower 4 is provided with an axial flow impeller 7, a fan motor 8 positioned in a suction side of the axial flow impeller 7, and a pair of motor stays 9 and 9 supporting the fan motor 8. The motor stays 9 and 9 are formed substantially as a linear shape, and are built between an upper end of the heat exchanger 2 and an upper end of a front surface plate 10 in the lower casing 1A in such a manner as to become in parallel to a surface of rotation of the axial flow impeller 7. The motor stays 9 and 9 are formed to have a rectangular cross-section, however, may be formed to have a circular cross-section. In this case, the width W of each motor stay 9 indicates the diameter.

In an outer periphery of the axial flow impeller 7 constructing the blower 4, there is arranged a bell mouth 12 having an upper end engaged with a supporting hole 11 formed on a top surface of the upper casing 1B and having an substantially cylindrical shape. An opening of an upper end of the bell mouth 12 constructs an air blowing port 13 of the outdoor unit.

The axial flow impeller 7 is constituted by a cylindrical boss 15 positioned in the center, and a plurality of (four in the present embodiment) impeller blades 16*a*, 16*b*, 16*c* and 16*d*. One end each of the impeller blades 16*a*, 16*b*, 16*c*, and 16*d* is attached to an outer periphery of the boss 15. The arrangement of the impeller blades 16*a*, 16*b*, 16*c* and 16*d* is constituted by an uneven pitch arrangement in which a mounting angle $\alpha$ of the impeller blades 16*a* and 16*c* is not equal to a mounting angle $\beta$ of the impeller blades 16*b* and 16*c*. This structure is provided for slightly shifting an interference cycle between each of the impeller blades 16*a*, 16*b*, 16*c* and 16*d* and a side wall of the casing, and a generation cycle of a vane surface turbulence generated by a drift of the suction air flow in a rotating direction, in accordance with the downsizing of the air conditioner outdoor unit. As a result, an increase of the NZ noise is suppressed, and it is possible to improve the noise characteristics as a whole. In this case, suffixes a to d of reference numeral 16 are provided for differentiating each of the impeller blades 16. In the present embodiment, in order to keep the balance of the uneven pitch impeller blades, there is employed an uneven pitch arrangement in which the mounting angle $\alpha$ of the impeller blades 16*a* and 16*c* is not equal to the mounting angle $\beta$ of the impeller blades 16*b* and 16*c*. However, in four impeller blades and five impeller blades, the impeller blades may be arranged at random and the balance of the axial flow impeller 7 may be kept by other means (for example, changing the weight of each of the impeller blades).

In this case, since the dimension in the height direction of the outdoor unit is limited in accordance with the downsizing of this kind of air conditioner outdoor unit, the dimension in the height direction of the upper casing 1B is reduced. Accordingly, as mentioned above, the distance between the motor stays 9 and 9 and the axial flow impeller 7 is reduced as well, and the air flow turbulence in the wake flow of the motor stays 9 and 9 affects the aerodynamic characteristics and the noise characteristics of the axial flow impeller 7. In order to solve the problem mentioned above, it is necessary to optimize the distance between the motor stays 9 and 9, and an impeller blade front edge 17 forming a front end with respect to a rotating direction M of the axial flow impeller 7.

Accordingly, in the present embodiment, in the case where the distance between the upper surfaces of the motor stays 9 and 9 and the impeller blade front edge 17 in the axial flow impeller 7 is represented by L, and the width of each of the motor stays 9 to is represented by W, the values L and W are set in a range satisfying $0.5<L/W<2.5$.

Figure 3:
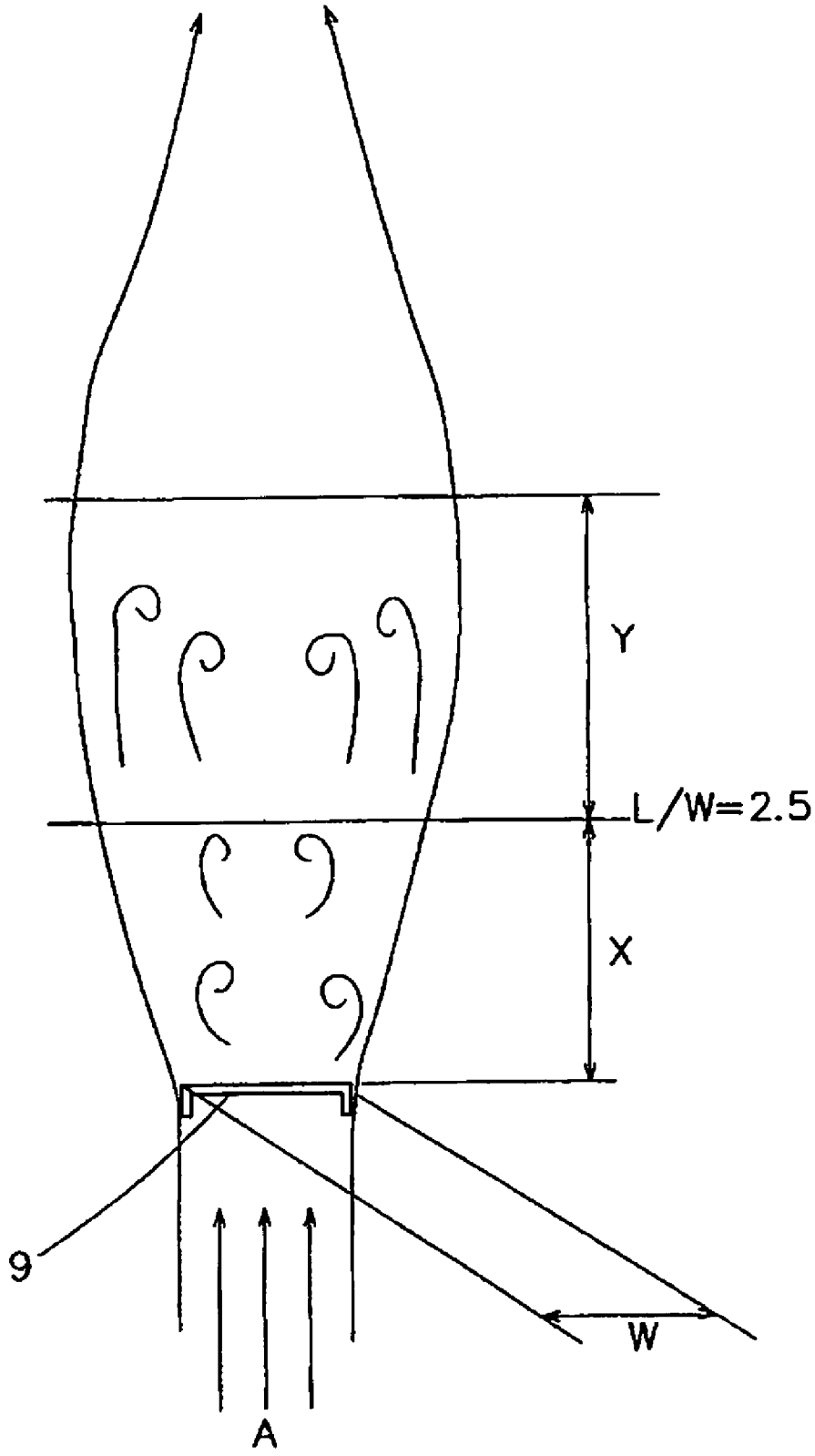
FIG. 3 is a schematic view showing a state of an air flow in a wake flow of a motor stay in the blower.

A research into the air flow of the wake flow of the motor stay 9 shows that, as shown in FIG. 3, there is generated a phenomenon that an air flow A is separated immediately after passing through the motor stay 9, a dead water region is formed at the back of the motor stay 9, and the separated shear layer (that is, the boundary of the separated air flow) is temporarily expanded, and is thereafter reduced.

Taking the phenomenon mentioned above into consideration, it is preferable that the impeller blade front edge 17 in the axial flow impeller 7 is arranged in such a manner as to be positioned in a region X which is upstream of a region Y in which the width of the wake flow becomes maximum, and in which region X the width of the wake flow is narrower than the region Y. The boundary between the region X and the region Y satisfies the relation $L/W=2.5$. Accordingly, as mentioned above, it is preferable that the values L and W are set in the range satisfying $L/W<2.5$. On the other hand, if the motor stay 9 and the impeller blade front edge 17 of the axial flow impeller 7 come too close to each other, the generation of an interference noise between the both presents a problem. Accordingly, it is preferable that the values L and W are set to the range satisfying $0.5<L/W$.

In the case where the impeller blade front edge 17 is positioned in the region Y in which the width of the wake flow is expanded, the influence of the wake flow turbulence becomes great, and the noise characteristics are deteriorated. Further, since the wake flow turbulence is reduced on the downstream side of the region Y, it is possible to make the influence of the wake flow turbulence small in the case that the impeller blade front edge 17 is positioned on the downstream side of the region Y. However, this structure runs counter to the downsizing of the outdoor unit, and the shaft power of the fan motor 8 is increased.

In accordance with the structure mentioned above, the following operations and advantages are obtained.

It is possible to inhibit the air flow turbulence in the wake flow of the motor stays 9 and 9 from affecting the aerodynamic characteristics and the noise characteristics (for example, the increase of the NZ noise) of the axial flow impeller 7, and it is possible to achieve both of the downsizing of the blower and the reduction of the NZ noise.

Further, since the values L and W are set in the range satisfying $0.5<L/W<2.5$, it is possible to achieve the reduction of the NZ noise without significantly increasing the shaft power of the fan motor 8, and it is possible to prevent the generation of the interference noise caused by the motor stays 9 and 9 and the impeller blade front edge 17 of the axial flow impeller 7 coming too close to each other.

Further, since the arrangement of the impeller blades of the axial flow impeller 7 is constituted by the uneven pitch arrangement, it is possible to slightly shift the interference cycle between each of the impeller blades 16*a*, 16*b*, 16*c* and 16*d* and the side wall of the casing, and the generation cycle of the vane surface turbulence generated by the drift in the rotating direction of the suction air flow. As a result, the increase of the NZ noise can be suppressed, and it is possible to improve the noise characteristics as a whole.

It should be apparent to those skilled in the art that the present invention may be embodied in many other specific forms without departing from the spirit or scope of the invention.

The invention claimed is:

1. A blower comprising an axial flow impeller, a fan motor positioned on a suction side of the axial flow impeller, and a motor stay supporting the fan motor, wherein the motor stay is substantially formed to have a linear shape and a rectangular cross-section and attached in parallel to a rotating surface of the axial flow impeller, the blower comprising an impeller blade front edge of the axial flow impeller that is positioned in a first region which is closer to the motor stay than a second region in which an air flow turbulence in a wake flow of the motor stay is expanded, and in the first region a range of the air flow turbulence is narrower than the second region, and wherein values L and W are set to a range satisfying $0.5<L/W<2.5$, in which an interval between the motor stay and the impeller blade front edge of the axial flow impeller is represented by L, and a width of the motor stay is represented by W.

2. The blower according to claim 1, wherein an arrangement of the impeller blades of the axial flow impeller is an uneven pitch arrangement.

3. An upward blowing type air conditioner outdoor unit having the blower according to any one of claims 1 and 2.

* * * * *